US011305445B1

(12) United States Patent
Peachey

(10) Patent No.: US 11,305,445 B1
(45) Date of Patent: Apr. 19, 2022

(54) SURFACE TEXTURING APPARATUS

(71) Applicant: John Peachey, Newport, PA (US)

(72) Inventor: John Peachey, Newport, PA (US)

(73) Assignee: John Peachey, Newport, PA (US)

( * ) Notice: Subject to any disclaimer, the term of this patent is extended or adjusted under 35 U.S.C. 154(b) by 50 days.

(21) Appl. No.: 16/875,302

(22) Filed: May 15, 2020

Related U.S. Application Data

(60) Provisional application No. 63/014,951, filed on Apr. 24, 2020.

(51) Int. Cl.
*B26D 3/08* (2006.01)

(52) U.S. Cl.
CPC ..... *B26D 3/08* (2013.01)

(58) Field of Classification Search
CPC ..... B26D 3/08; B27M 1/003
See application file for complete search history.

(56) References Cited

U.S. PATENT DOCUMENTS

| | | | | |
|---|---|---|---|---|
| 164,276 | A | 6/1875 | DuFour et al. | |
| 258,388 | A | 5/1882 | DeWitt | |
| 397,568 | A | 2/1889 | Rudolph | |
| 1,314,834 | A | 9/1919 | Smith | |
| 1,387,873 | A | 8/1921 | Walker | |
| 2,722,956 | A | 11/1955 | Ludwig | |
| 2,829,686 | A * | 4/1958 | Hecht | B27M 1/003 144/136.1 |
| 2,892,475 | A * | 6/1959 | Lapsley | B23Q 5/04 144/48.1 |
| 2,922,448 | A | 1/1960 | Standal | |
| 2,940,489 | A | 6/1960 | Feiner | |
| 3,190,326 | A | 6/1965 | Standal | |

(Continued)

FOREIGN PATENT DOCUMENTS

| | | |
|---|---|---|
| AT | 14605 | 2/2016 |
| CA | 2402087 A1 | 9/2004 |

(Continued)

OTHER PUBLICATIONS

Hosking, Jeff: "Hand Scraped Hardwood Flooring All you Need to Know Before you Buy", https://www.hoskinghardwood.com/Department/Hardwood-Floors/Hand-Scraped-Hardwood-Flooring.aspx?dld-7&pages, 2007.

*Primary Examiner* — Stephen Choi
(74) *Attorney, Agent, or Firm* — McNees Wallace & Nurick LLC

(57) ABSTRACT

A surface texturing apparatus is disclosed comprising an actuated tool holder, at least two independent actuators, a cutting tool, and a guide for positioning an article in relation to the apparatus. A method of replicating a circular saw milled texture in the surface of the article is further disclosed. A first actuator draws the cutting tool across the surface of the article along an arcuate path having a predetermined effective radius, carving a groove into the surface of the article which replicates a circular saw milling mark of a circular saw blade having the predetermined effective radius. A second actuator modulates distance between or overlap of the cutting tool and the surface. As the article is advanced along the surface texturing apparatus, a plurality of replicated circular saw milling marks are carved into the surface of the article, replicating the circular saw milled texture.

14 Claims, 3 Drawing Sheets

(56) References Cited

U.S. PATENT DOCUMENTS

| | | | | |
|---|---|---|---|---|
| 3,234,978 | A * | 2/1966 | Stolesen | B27B 5/08 144/136.1 |
| 3,345,244 | A | 10/1967 | Stolesen et al. | |
| 3,616,826 | A | 11/1971 | Murphey et al. | |
| 3,756,295 | A | 9/1973 | Halop | |
| 3,791,427 | A | 2/1974 | Haynes | |
| 3,913,642 | A | 10/1975 | Porter | |
| 4,184,526 | A | 1/1980 | Hanaya | |
| 4,712,596 | A | 12/1987 | McClaran | |
| 4,813,464 | A | 3/1989 | Zayat | |
| 4,844,134 | A | 7/1989 | Martindale | |
| 4,945,959 | A | 8/1990 | Biedenbach | |
| 4,949,768 | A | 8/1990 | Giles et al. | |
| 4,964,446 | A | 10/1990 | Ledinek | |
| 5,054,703 | A | 10/1991 | Morey | |
| 5,271,699 | A | 12/1993 | Barre et al. | |
| 5,649,578 | A | 7/1997 | Leguin | |
| 5,987,217 | A * | 11/1999 | Wisniewski | B27M 1/003 144/134.1 |
| 6,112,786 | A | 9/2000 | Otsuka et al. | |
| 6,371,176 | B1 | 4/2002 | Burr et al. | |
| 6,609,546 | B1 * | 8/2003 | Bobb | B27D 1/00 144/133.1 |
| 6,660,333 | B2 | 12/2003 | Frame | |
| 8,051,886 | B2 | 11/2011 | Tappan et al. | |
| 8,186,397 | B2 | 5/2012 | Hahn | |
| 9,033,009 | B2 | 5/2015 | Peronto et al. | |
| 9,108,335 | B2 | 8/2015 | Beakler et al. | |
| 9,452,545 | B1 | 9/2016 | Yoder, Jr. et al. | |
| 10,071,456 | B2 | 9/2018 | Rees et al. | |
| 2009/0223600 | A1 * | 9/2009 | Tappan | B27M 3/04 144/357 |
| 2016/0176068 | A1 * | 6/2016 | Myers | B44C 1/00 144/363 |

FOREIGN PATENT DOCUMENTS

| | | | |
|---|---|---|---|
| CN | 1051004 | A | 5/1991 |
| CN | 2083972 | | 9/1991 |
| CN | 102501280 | A | 6/2012 |
| CN | 102773540 | B | 12/2014 |
| CN | 108393990 | A | 8/2018 |
| CN | 109454736 | A | 3/2019 |
| CN | 209478389 | | 10/2019 |
| DE | 2727667 | A1 | 1/1979 |
| DE | 3504574 | C2 | 9/1994 |
| EP | 3517261 | A1 | 7/2019 |
| GB | 2321426 | B | 7/1998 |
| JP | 2013000810 | A | 1/2013 |
| JP | 2014134296 | A | 7/2014 |

* cited by examiner

SURFACE TEXTURING APPARATUS

FIELD OF THE INVENTION

This application is directed to a surface texturing apparatus. More specifically, this application is directed to a surface texturing apparatus that replicates circular saw milled texture in a substrate, particularly in wood and wood substitutes.

BACKGROUND OF THE INVENTION

Wood planks cut by circular saws in sawmills prior to the advent of modern milling machines and techniques typically had distinctive patterns in the surface of the planks as a result of their method of production, in particular sequential arcuate cut marks of somewhat irregular depth. Modern machines and procedures for producing lumber do not leave such distinctive patterns. Additionally, wood replacement materials have surfaces which are even further removed from such machining patterns. Although modern production methods are more efficient, the rustic appearance of traditional circular saw milled wood has become highly desirable for aesthetic reasons.

Desirable uses or building materials having traditional circular saw milling markings includes wood flooring and engineered flooring materials, furniture, wall and ceiling paneling, wood and wood-plastic siding, decking materials, and cabinetry. However, manufacturers willing to produce traditional circular saw cut wood are rare due to the inefficient process which is both time and labor-intensive. While such materials are obtainable, supply is limited and costs are high. Existing methods for simulating circular saw milling markings do not create aesthetically acceptable substitutes, as the patterns formed are too regular to give the impression of anything other than a counterfeit.

BRIEF DESCRIPTION OF THE INVENTION

In one exemplary embodiment, a surface texturing apparatus includes an actuated tool holder, at least two independent actuators, a cutting tool mounted to the actuated tool holder, and a guide for positioning an article in relation to the surface texturing apparatus such that a surface of the article facing the cutting tool is at a predetermined mean distance from or overlap with the cutting tool. The at least two independent actuators include a first actuator and second actuator. The first actuator draws the cutting tool across the surface of the article along an arcuate path having a predetermined effective radius, carving a groove into the surface of the article which replicates a circular saw milling mark of a circular saw blade having the predetermined effective radius. The second actuator modulates the distance between or overlap of the cutting tool and the surface of the article facing the cutting tool. As the article is advanced along the surface texturing apparatus, a plurality of replicated circular saw milling marks are carved into the surface of the article facing the cutting tool, replicating a circular saw milled texture in the surface of the article facing the cutting tool.

In another exemplary embodiment, a method for replicating a circular saw milled texture in the surface of an article includes positioning the article with a guide such that a surface of the article is disposed at a predetermined mean distance from or overlap with a cutting tool mounted to an actuated tool holder of a surface texturing apparatus, the surface texturing apparatus including at least two independent actuators. The cutting tool is drawn across the surface of the article along an arcuate path having a predetermined effective radius, carving a groove into the surface of the article which replicates a circular saw milling mark of a circular saw blade having the predetermined effective radius. The distance between or overlap of the cutting tool and the surface of the article facing the cutting tool is modulated. The article is advanced along the surface texturing apparatus, carving a plurality of replicated circular saw milling marks into the surface of the article facing the cutting tool, replicating the circular saw milled texture in the surface of the article. The first actuator draws the cutting tool across the surface of the article and the second actuator modulates the distance between or overlap of the cutting tool and the surface of the article facing the cutting tool.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
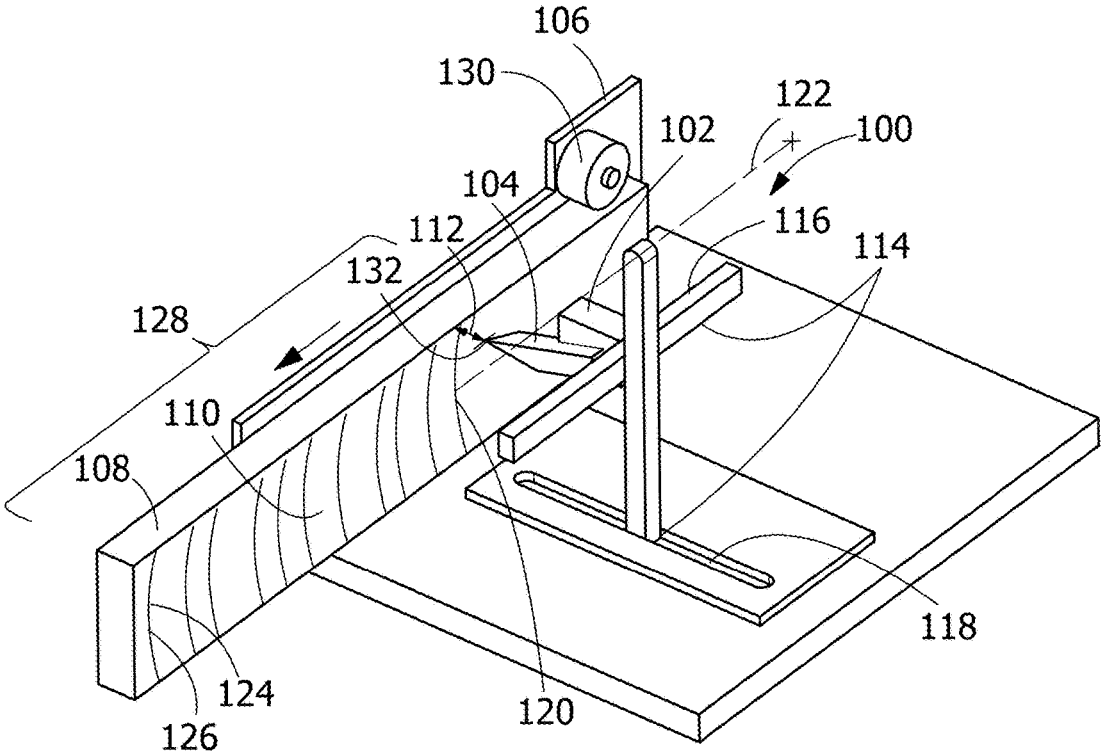
FIG. 1 is a schematic representation of a surface texturing apparatus, according to an embodiment of the present disclosure.

Referring to FIG. 1, in one embodiment, a surface texturing apparatus 100 includes an actuated tool holder 102, a cutting tool 104 mounted to the actuated tool holder 102, and a guide 106 for positioning an article 108 in relation to the surface texturing apparatus 100 such that a surface 110 of the article 108 facing the cutting tool 104 is at a predetermined mean distance from or overlap with 112 the cutting tool 104. The surface texturing apparatus 100 includes at least two independent actuators 114, including at least a first actuator 116 and a second actuator 118. The first actuator 116 draws the cutting tool 104 across the surface 110 of the article 108 along an arcuate path 120 having a predetermined effective radius 122, carving a groove 124 into the surface 110 of the article 108 which replicates a circular saw milling mark of a circular saw blade having the predetermined effective radius 122. The second actuator 118 modulates the distance between or overlap of 112 the cutting tool 104 and the surface 110 of the article 108 facing the cutting tool 104. As the article 108 is advanced along the surface texturing apparatus 100, a plurality of replicated circular saw milling marks 126 are carved into the surface 110 of the article 108 facing the cutting tool 104, replicating a circular saw milled texture 128 in the surface 110 of the article 108 facing the cutting tool 104.

In one embodiment, the second actuator 118 is arranged and disposed to modulate the distance between or overlap of 112 the cutting tool 104 and the surface 110 of the article 108 facing the cutting tool 104 between or during the carving of each groove 124 into the surface 110 of the article 108, effecting a pseudo-random modulation of the circular saw milled texture 128. As used herein, "pseudo-random modulation" indicates a pattern that, while deliberate and predictable based on the structure, parameters, and usage of the surface texturing apparatus 100, nevertheless appears to be random given the size of the article 108. The pseudo-random modulation replicates the somewhat irregular depth and spacing of traditional circular saw milled wood arcuate cut marks. The position of the second actuator 118 may be controlled manually, mechanically or via computer, such as with a programmable logic controller ("PLC"). The distance between or overlap of 112 the cutting tool 104 and the surface 110 of the article 108 facing the cutting tool 104 may be modulated in between the times of arcuate travel of the first actuator 116 such that individual grooves may independently be of a constant, but different depth from some other grooves. The distance between or overlap of 112 the cutting tool 104 and the surface 110 of the article 108 facing the cutting tool 104 may also be varied during the arcuate travel of the first actuator 116 such that the depth of each individual groove may itself vary along its path across the article 108. The second actuator 118 may actuate the actuated tool holder 102 or the guide for positioning the article 108.

The effective radius 122 may be any suitable radius for the circular saw milled texture 128, including, but not limited to, an effective radius of between about 15 inches to about 39 inches, alternatively between about 21 inches to about 33 inches, alternatively between about 24 inches to about 30 inches, alternatively about 27 inches, or any sub-range within the preceding ranges. It is noted that an effective radius of about 27 inches would replicate the circular saw milling marks of a 54-inch circular saw blade (also referred to as a "headrig"). Modulation of the depth of the replicated circular saw milling marks 126 may be set to any suitable range, including, but not limited to, variations in depth between replicated circular saw milling marks 126 of the circular saw milled texture 128 of between about 2 mils (thousandths of an inch) to about 50 mils, alternatively between about 5 mils to about 30 mils, alternatively between about 10 mils to about 15 mils. Although variation of depth of between about 2 mils to about 50 mils may accurately replicate variations found in traditional milled wood, exaggerated depth variations for aesthetic purposes may also be replicated by the surface texturing apparatus 100, including variations in depth between replicated circular saw milling marks 126 of the circular saw milled texture 128 of up to a about 75 mils, alternatively up to about 100 mils, alternatively up to about 125 mils, alternatively up to about 150 mils.

The grooves 124 may have any suitable cross-sectional shape, including, but not limited to, triangular, concave, irregular, or combinations thereof, depending on the shape of the cutting tool 104 and the angle and depth at which the cutting tool 104 interacts with the surface 110 of the article 108. In one embodiment, the grooves 124 have an average width to depth ratio of 2:1 to 5:1.

Figure 4:
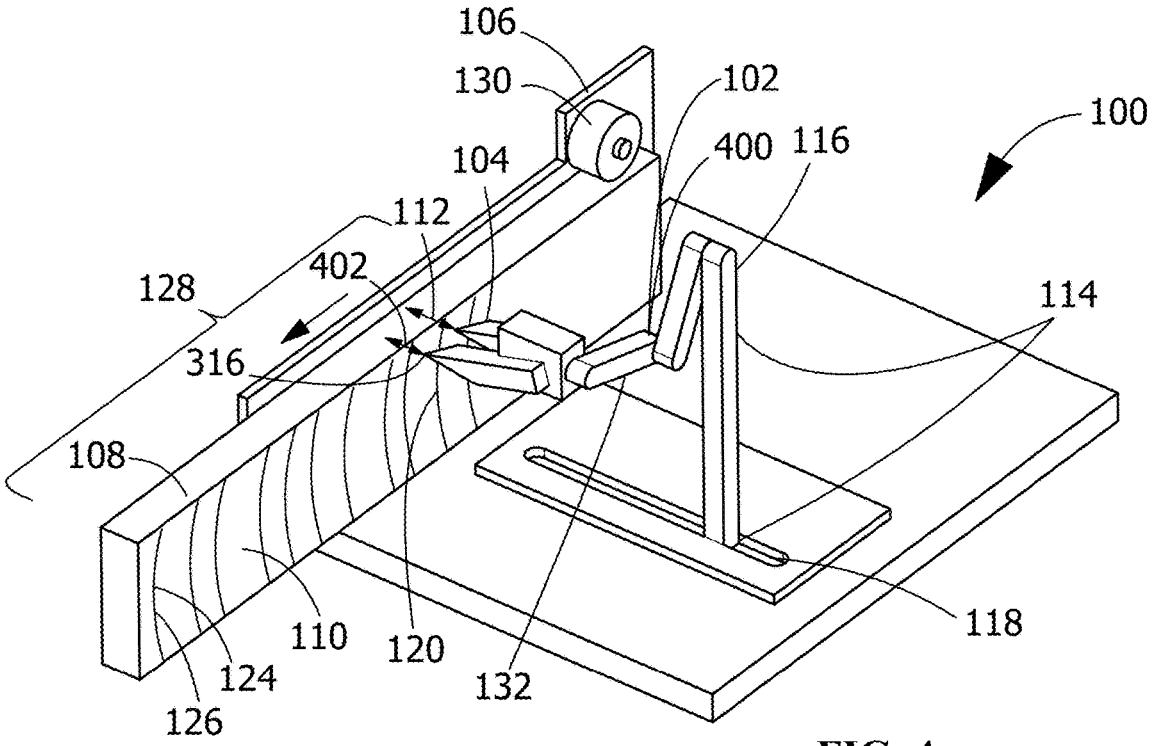
FIG. 4 is a schematic representation of a surface texturing apparatus with an articulated arm, according to an embodiment of the present disclosure.
Figure 5:
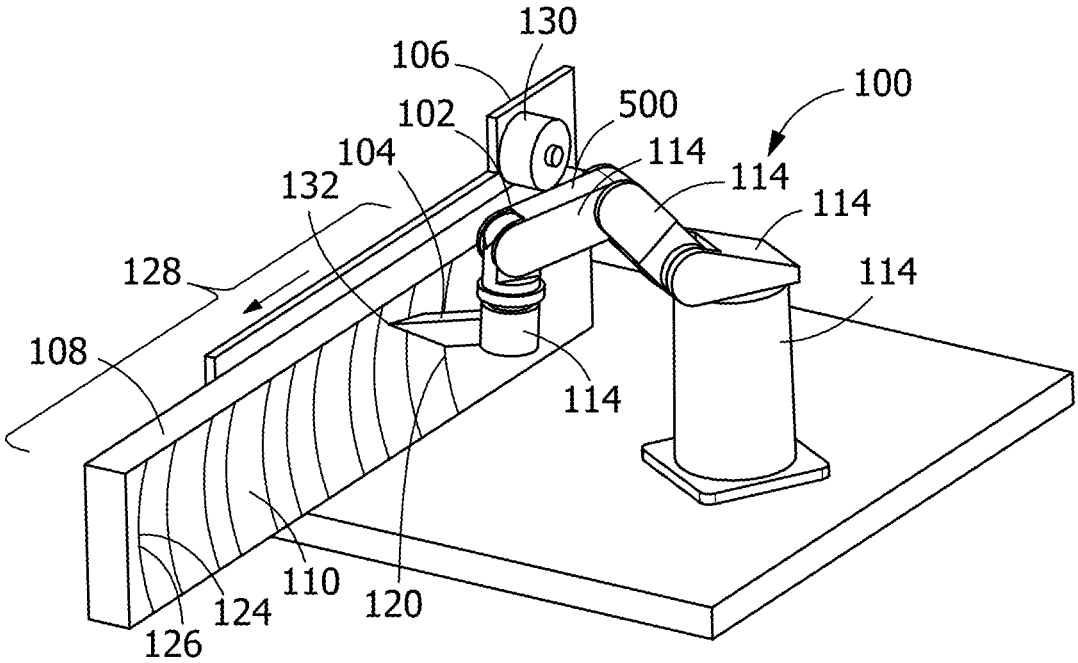
FIG. 5 is a schematic representation of a surface texturing apparatus with a three-axis robot arm, according to an embodiment of the present disclosure.

The at least two independent actuators 114 may further include a third actuator 130 which advances the article 108 along the surface texturing apparatus 100. Suitable third actuators 130 include, but are not limited to, pressurized wheels, conveyor belts, ramrods, or combinations thereof. The third actuator 130 may be arranged and disposed to advance the article 108 along the surface texturing apparatus 100 at a constant speed or to vary the speed at which the article 108 advances along the surface texturing apparatus 100. Varying the speed at which the article 108 advances along the surface texturing apparatus 100 may contribute to the pseudo-random modulation of the circular saw milled texture 128. Although the third actuator 130 is depicted in FIGS. 1, 4, and 5 in a particular orientation relative to the article 108 and the actuated tool holder 102, it will be appreciated that the third actuator 130 may contact any desired surface or combination or surfaces of the article 108. In one embodiment, the third actuator 130 may contact the article 108 such that the article 108 is disposed between the third actuator 130 and the guide 106, and the third actuator 130 pins the article 108 against the guide 106.

In one embodiment, the actuated tool holder 102 may be vertically adjusted so as to vary the portion of the surface 110 of the article 108 the cutting tool 104 interacts with or to alter the sweep of the circular saw milled texture 128. In another embodiment the guide 106 includes a vertical support surface which is adjustable so as to vary the portion of the surface 110 of the article 108 the cutting tool 104 interacts with or to alter the sweep of the circular saw milled texture 128.

The cutting tool 104 may be any suitable cutting article or apparatus, and may be selected based on the material composition of the surface 110 of the article 108 which is to be worked by the cutting tool 104. Suitable cutting tools 104 include, but are not limited to, the cutting tip 132 of a chip breaker, such as a CCGT chip breaker, circular saw bits, chisel edges, stylus points, angled planer blades, or combinations thereof. The cutting tool 104 may be made from any suitable material, including, but not limited to, steels, tool steels, carbon tool steels, cemented carbides, tungsten carbides, cobalt carbides, cermets, ceramics, cubic boron nitrides, diamond coatings, diamond tips, or combinations thereof. The cutting tool 104 is arranged and disposed so the cutting tip 132 contacts the article 108 in a way that simulates a kerf of a headrig saw blade as it bites into wood during rough sawing.

The article 108 may be any suitable article, including, but not limited to, lumber, wood planks, edge-glued wood panels, particle board, plywood, composite boards, plastic boards, plastic mineral composite boards, wood flooring, engineered flooring materials, furniture, decking materials, wood siding, wood-plastic siding, casketry, and cabinetry. Advantageously, while exemplary embodiments may replicate the appearance of rough-sawn lumber, the surface treatment accomplished with exemplary embodiments of the invention can be applied to finished boards that are already otherwise in their final production geometry, having been previously squared, planed, sanded, or otherwise subjected to the appropriate finishing treatments.

Figure 2:
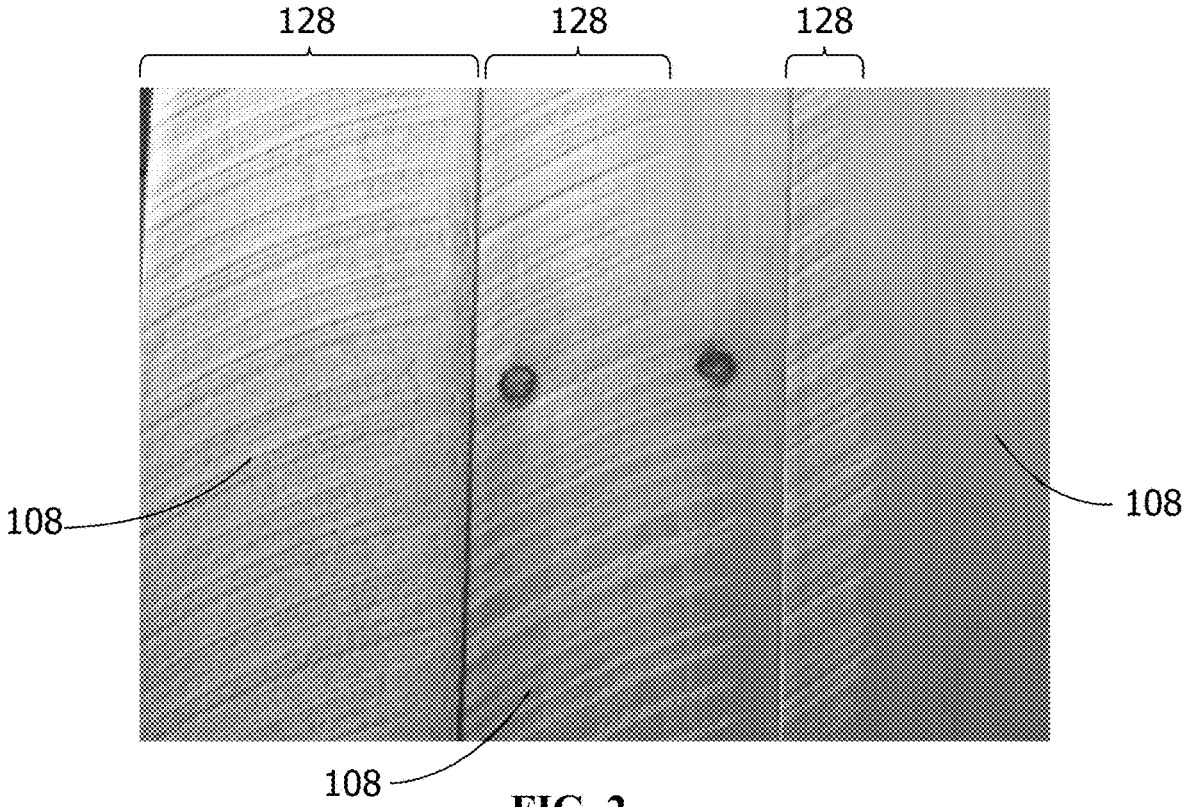
FIG. 2 is a picture of an article having replicated circular saw milling marks effecting a circular saw milled texture, according to an embodiment of the present disclosure.

Referring to FIG. 2, a picture of an exemplary article 108 having replicated circular saw milling marks 126 effecting a circular saw milled texture 128 is disclosed. Articles 108 having the circular milled texture may be used for digital scanning, texturing, and printing applications for lumber, wood planks, edge-glued wood panels, particle board, plywood, composite boards, plastic boards, plastic mineral composite boards, wood flooring, engineered flooring materials, furniture, wood siding, wood-plastic siding, decking materials, casketry, and cabinetry.

Figure 3:
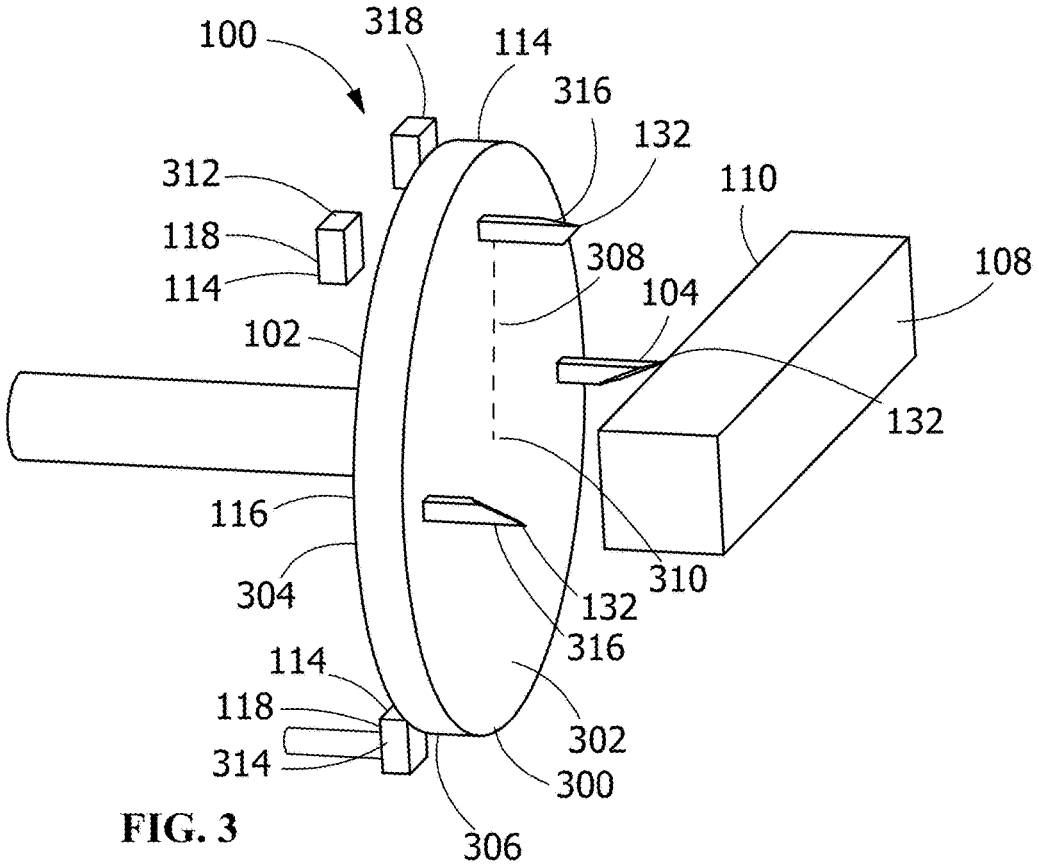
FIG. 3 is a schematic representation of a surface texturing apparatus with a rotating disk, according to an embodiment of the present disclosure.

Referring to FIG. 3, in one embodiment the first actuator 116 is a rotating disk 300 having a first face 302, a second face 304, and an edge 306, and the cutting tool 104 is mounted to the first face 302 of the rotating disk at a radial distance 308 from a center 310 of the rotating disk 300, the radial distance 308 defining the predetermined effective radius 122. The rotating disk 300 may rotate at a constant speed or the speed at which the rotating disk rotates may be varied.

The second actuator 118 may translate the cutting tool 104 toward and away from the surface 110 of the article 108 facing the cutting tool 104 or may translate the guide 106 toward and way from the cutting tool 104 by any suitable manipulation. The second actuator 118 may further tilt the guide so as to modulate the angle at which the cutting tool 104 meets the surface 110, or may further tilt the cutting tool 104 so as to modulate the angle at which the cutting tool 104 meets the surface 110. In one embodiment, the second actuator 118 induces rotational wobble in the rotating disk 300, and the rotational wobble translates the cutting tool 104 toward and away from the surface 110 of the article 108 facing the cutting tool 104. The second actuator 118 may include any suitable engagement with the rotating disk 300, including, but not limited to, a non-contacting actuator 312, such as, but not limited to, an air jet that directs a pressurized jet of air against the rotating disk 300, a water jet that directs a pressurized jet of water against the rotating disk 300, an electromagnet 312 that magnetically pushes and/or pulls on a portion of the rotating disk 300, or a combination thereof, to induce the rotational wobble, or a contacting actuator 314 such as, but not limited to, an adjustable guide, a hydraulic, pneumatic, or electromagnetic rod, a hydraulic, pneumatic, or electromagnetic block, a hydraulic, pneumatic, or electromagnetic hammer, or combinations thereof, that mechanically push on a portion of the rotating disk 300 to induce the rotational wobble, or combinations thereof.

The rotational wobble may be a regular oscillation or an irregular oscillation. The rotational wobble may be limited by a guide block 318 adjacent to the rotating disk 300. The guide block 318 may be fixed, adjustable offline, or adjustable during operation. In lieu or of in addition to inducing rotational wobble in the rotating disk 300, the second actuator 118 may axially translate the rotating disk 300 toward and away from the surface 110 of the article 108 facing the cutting tool.

The surface texturing apparatus 100 may include at least one additional cutting tool 316 mounted to the rotating disk 300 at about the radial distance 308 from the center 310 of the rotating disk 300 and circumferentially displaced from the cutting tool 104 around the rotating disk 300. The at least one additional cutting tool 316 may include any suitable number of additional cutting tools 316, including, but not limited to, at least 5, and least 15, at least 20, at least 25, at least 30, at least 35, at least 40, at least 45, at least 50, at least 75, or at least 100 additional cutting tools 316. The cutting tool 104 and the at least one additional cutting tool 316 may be evenly distributed around the rotating disk 300 or may be unevenly distributed around the rotating disk 300.

Referring to FIG. 4, in one embodiment the first actuator 116 is an articulated arm 400 which draws the cutting tool 104 across the surface 110 of the article 108 along the arcuate path 120. The second actuator 118 may translate the articulated arm 400 or a portion of the articulated arm 400 toward and away from the surface 110 of the article 108 facing the cutting tool 104, or may translate the guide 106 toward and away from the cutting tool 104. The surface texturing apparatus 100 may include at least one additional cutting tool 316 mounted to the articulated arm 300. The at least one additional cutting tool 316 may include any suitable number of additional cutting tools 316, including, but not limited to, at least 2, at least 3, at least 4, at least 5, at least 6, at least 7, at least 8, at least 9, at least 10, at least 15, or at least 20 additional cutting tools 316. The cutting tool 104 and the at least one additional cutting tool 316 may be mounted to the articulated arm 400 such that the surface 110 of the article 108 facing the at least one additional cutting tool 316 is at a second predetermined mean distance from or overlap with 402 the at least one additional cutting tool 316 less than the predetermined mean distance from or overlap with 112 the cutting tool 104, or the surface 110 of the article 108 facing the at least one additional cutting tool 316 is at the predetermined mean distance from or overlap with 112 the at least one additional cutting tool 316.

Referring to FIG. 5, in one embodiment, the actuated tool holder 102 is a three-axis robot arm 500.

Referring to FIGS. 1-5, in one embodiment, a method for replicating a circular saw milled texture in the surface 110 of an article 108 includes positioning the article 108 with a guide 106 such that the surface 110 of the article 108 is disposed at a predetermined mean distance from or overlap with 112 a cutting tool 104 mounted to an actuated tool holder 102 of a surface texturing apparatus 100, the actuated tool holder 102 including at least two independent actuators 114. The cutting tool 104 is drawn across the surface 110 of the article 108 along an arcuate path 120 having a predetermined effective radius 122, carving a groove 124 into the surface 110 of the article 108 which replicates a circular saw milling mark of a circular saw blade having the predetermined effective radius 122. The cutting tool 104 is translated toward and away from the surface 110 of the article 108 facing the cutting tool 104. The article 108 is advanced along the surface texturing apparatus 100, carving a plurality of replicated circular saw milling marks 126 into the surface 110 of the article 108 facing the cutting tool 104, replicating the circular saw milled texture 128 in the surface 110 of the article 108. The first actuator 116 draws the cutting tool 104 across the surface 110 of the article 108 and the second actuator 118 translates the cutting tool 104 toward and away from the surface 110 of the article 108 facing the cutting tool 104. The surface texturing apparatus 100 may replicate the circular saw milled texture 128 in a portion of the surface 110 of the article 108 or across the entire surface 110 of the article 108. Additionally, by adjusting the position of the article 108 relative to the position of the first actuator 116 prior to drawing the cutting tool across the surface can result in providing a user the ability to further create varied appearances associated with boards being cut at different positions with respect to a center axis of the headrig blade pattern being replicated.

Replicating the circular saw milled texture 128 in the surface 110 of the article 108 may further include any suitable finishing treatment, including, but not limited to, wire brushing, staining, weathering, sanding, or combinations thereof. Such finishing treatments may further provide a distressed or aged aesthetic to the article 108.

Although FIGS. 1 and 3-5 illustrate the surface texturing apparatus 100 and the article 108 in certain orientations and positions relative to one another, it will be appreciated that the actuated tool holder 102, the cutting tool 104, and the guide 106 may be configured or oriented such that the cutting tool 104 interacts with any surface 110 of the article 108. Such configuration or orientation may include repositioning the guide 106 to accommodate an alternative orientation of the article 108 so as to expose a different surface 110 of the article 108 to the cutting tool 104, or it may include changing the angle of the cutting tool 104 relative to the surface 110 of the article 108, or it may include repositioning the actuated tool holder 102 above or below the article 108 rather than to one side as depicted in FIGS. 1 and 3-5, or any combination of the foregoing. The entire surface texturing apparatus 100 could be oriented vertically or diagonally rather than horizontally. In such a manner the surface texturing apparatus 100 may be configured so as to accommodate any particular shape or size of the article 108. Further, although the surface 110 of the article 108 illustrated in the figures is a particular face in the drawings, it will be appreciated that any surface of the article 108 may be deemed to be the surface 110.

Unless indicated to the contrary, as used herein, "about" signifies a deviation from the modified value of up to 5% of the modified value. Any value modified by "about" is intended to inherently recite all tolerances of less than 5% as well.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A surface texturing apparatus, comprising:

an actuated tool holder including:

a first actuator including a rotating disk having a first face, a second face, and an edge;

a cutting tool mounted to the first face of the rotating disk at a radial distance from a center of the rotating disk, the radial distance defining a predetermined effective radius of the actuated tool holder;

a second actuator; and a guide for positioning an article in relation to the surface texturing apparatus such that a surface of the article facing the cutting tool is at a predetermined mean distance from or overlap with the cutting tool, the first actuator is configured to draw the cutting tool across the surface of the article facing the cutting tool along an arcuate path having the predetermined effective radius, carving a groove into the surface of the article facing the cutting tool which replicates a circular saw milling mark of a circular saw blade having the predetermined effective radius;

the surface of the article facing the cutting tool also faces the first face of the rotating disk;

the second actuator is configured to modulate a distance between or overlap of the cutting tool and the surface of the article facing the cutting tool, and as the article is advanced along the surface texturing apparatus, the surface texturing apparatus is configured to carve a plurality of replicated circular saw milling marks into the surface of the article facing the cutting tool, replicating a circular saw milled texture in the surface of the article facing the cutting tool.

2. The surface texturing apparatus of claim 1, wherein the second actuator is arranged and disposed to modulate the distance between or overlap of the cutting tool and the surface of the article facing the cutting tool between or during the carving of each groove into the surface of the article, effecting a pseudo-random modulation of the circular saw milled texture.

3. The surface texturing apparatus of claim 1, wherein the second actuator actuates the actuated tool holder or the cutting tool.

4. The surface texturing apparatus of claim 1, wherein the second actuator actuates the guide for positioning the article.

5. The surface texturing apparatus of claim 1, wherein the at least two independent actuators include a third actuator which advances the article along the surface texturing apparatus.

6. The surface texturing apparatus of claim 5, wherein the third actuator is arranged and disposed to vary a speed at which the article advances along the surface texturing apparatus while replicating the circular saw milled texture, effecting a pseudo-random modulation of the circular saw milled texture.

7. The surface texturing apparatus of claim 1, wherein the cutting tool is selected from the group consisting of chip breakers, circular saw bits, chisel edges, stylus points, angled planer blades, and combinations thereof.

8. The surface texturing apparatus of claim 1, wherein the second actuator induces rotational wobble in the rotating disk, and the rotational wobble translates the cutting tool toward and away from the surface of the article facing the cutting tool.

9. The surface texturing apparatus of claim 8, wherein the second actuator is selected from the group consisting of an air jet, a water jet, an electromagnet, an adjustable guide, a hydraulic, pneumatic, or electromagnetic rod, a hydraulic, pneumatic, or electromagnetic block, or a hydraulic, pneumatic, or electromagnetic hammer, and combinations thereof.

10. The surface texturing apparatus of claim 8, wherein the rotational wobble is a regular oscillation.

11. The surface texturing apparatus of claim 8, wherein the rotational wobble is an irregular oscillation.

12. The surface texturing apparatus of claim 1, further including a guide block adjacent to the rotating disk which is arranged and disposed to limit rotational wobble of the rotating disk.

13. The surface texturing apparatus of claim 1, wherein the second actuator axially translates the rotating disk toward and away from the surface of the article facing the cutting tool.

14. The surface texturing apparatus of claim 1, further including at least one additional cutting tool mounted to the rotating disk at about the radial distance from the center of the rotating disk and circumferentially displaced from the cutting tool around the rotating disk.

* * * * *